US005756921A

United States Patent [19]

Dacko et al.

[11] Patent Number: 5,756,921

[45] Date of Patent: May 26, 1998

[54] WEAPON SYSTEM GUN PORT EMI-EMP SEAL

[75] Inventors: Scott G. Dacko, Urbana, Ill.; David S. Langerud, New Brighton; Ronald A. Larson, Minneapolis, both of Minn.

[73] Assignee: United Defense LP, Arlington, Va.

[21] Appl. No.: 573,791

[22] Filed: Dec. 18, 1995

[51] Int. Cl.[6] ..... F41H 5/20

[52] U.S. Cl. ..... 89/36.02; 89/36.14; 89/36.08; 89/36.03; 174/35 C

[58] Field of Search ..... 89/36.01, 36.02, 89/36.03, 36.08, 36.13, 36.14; 174/35 C, 35 GC; 324/627

[56] References Cited

U.S. PATENT DOCUMENTS 1,631,267 6/1927 Hemingway, Jr. ..... 174/35 C
3,474,992 10/1969 Schuck et al. ..... 89/36.14
4,029,969 6/1977 Kondo et al. ..... 307/10 R
4,088,058 5/1978 Flemming et al. ..... 89/36.13
4,307,431 12/1981 Sone et al. ..... 174/35 C
4,370,831 2/1983 Hamilton ..... 174/35 GC
4,635,529 1/1987 Tassie ..... 89/36.14

*Primary Examiner*—Stephen M. Johnson
*Attorney, Agent, or Firm*—Douglas W. Rudy; Michael B.K. Lee

[57] ABSTRACT

This invention relates to an EMI and EMP shield configured to arrest electromagnetic contamination of sensitive electrical and microprocessor equipment. Particularly, the present invention enables a positive dynamic seal for moving parts and joints by means of resilient and self-adjusting conductive contacts. The contacts provide electrical bonding, between otherwise separate and electromagnetically leaky joints, to arrest EMI and EMP contamination.

3 Claims, 2 Drawing Sheets

WEAPON SYSTEM GUN PORT EMI-EMP SEAL

FIELD OF THE INVENTION

The present invention relates to a protection device generally mounted at a gun port of a gun or similar weapon systems to enable electromagnetic shielding from both on-site and hostile sources.

DESCRIPTION OF THE PRIOR ART

Prior art shielding devices are designed to provide protection of a gun mount from damage while allowing the gun to move in a vertical direction. Further, a minimal amount of protection is implemented to shelter the gun mount from environmental electromagnetic field effects. However, the prior art shielding devices do not provide sufficient protection to weapon systems exposed to various electromagnetic interferences an(EMI) and electromagnetic pulse (EMP). Furthermore, modern gun systems are equipped with sensitive electronics and microprocessor controls which are highly susceptible to EMI and EMP effects. Accordingly, it is imperative to provide a shielding mechanism which anticipates both current and future engagement scenarios.

SUMMARY OF THE INVENTION

The present invention provides a structure and device which enable a substantial elimination of EMI and EMP influence on sensitive or otherwise susceptible electronic control equipment for guns and similar mechanisms. As indicated hereinabove, the prior art shielding devices are inadequate and do not meet requirements to protect sensitive equipment in highly EMI and EMP contaminated environments. Specifically, where there are interconnected and moving sections of a gun, the shielding device must not interfere with the normal operation of the weapon system. For example the MK 45 gun port shield is intended to provide protection of the MK 45 gun mount from damage while allowing the gun to move in the vertical direction. The maximum vertical size is a chord of 70 degrees of a circle of a 40 inch radius.

Accordingly, the shield must be compatible with the weapon system, relative to systems integration, and must not impact the normal operation of the weapon. Further, in weapon systems such as the MK 45, which is used aboard ships, the shield must provide protection from environmental EMI and EMP contamination which originate from the ship's normal operations as well as from hostile action. Generally present shields in weapon systems like the MK 45 provide some protection from on board electromagnetic influence but do not anticipate future hostile threats which may include intense EMP and EMI environments.

Future design of gun mounts will be required to meet more stringent electromagnetic environments. The present invention anticipates those future challenges and provides a reliable structure to counter EMI and EMP contamination such that vital weapon controls could remain unaffected. Further the present invention provides a structure which is compatible with a gun port configuration such as the MK 45.

New advances and features of the present invention will become apparent upon examination of the following description and drawings dealing with specific embodiments thereof.

DESCRIPTION OF THE PREFERRED EMBODIMENT

The present invention provides a method and device of electrically bonding metallic materials to shield sensitive electronic equipment from EMI and EMP. One of the most distinguished achievements of the present invention is its adaptability to weapon systems in which moving parts are electrically bonded while allowing the maneuverability of the weapon. Particularly, the present invention is suited to a configuration such as the MK 45 gun system in which the gun moves slidably in relation to the housing.

Figure 1:
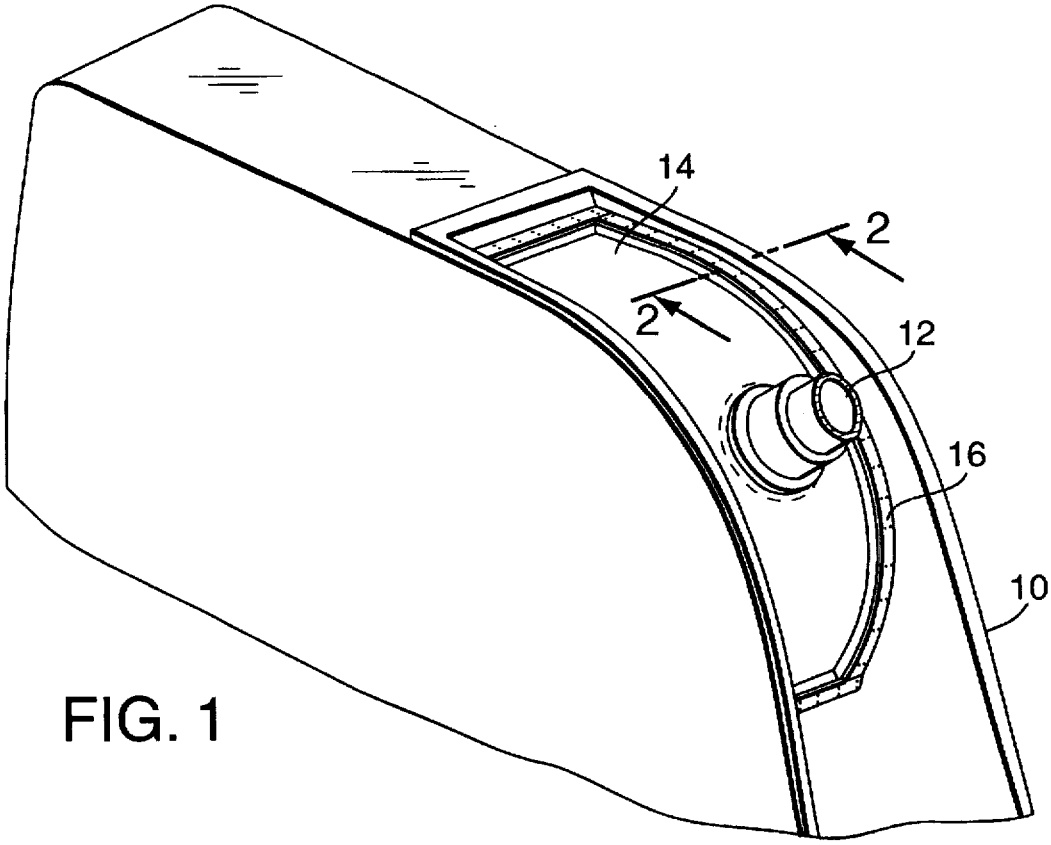
FIG. 1 is an isometric view of a gun system of the MK 45 type.

FIG. 1 shows a system of the MK 45 gun system type. Gun mount housing 10 is robust and provides a sufficient shield from most known EMP and EMI influence. Gun tube 12 is centrally located and is attached to gun port 14 which slidably engages metallic shield of gun port shield structure 16.

Figure 2:
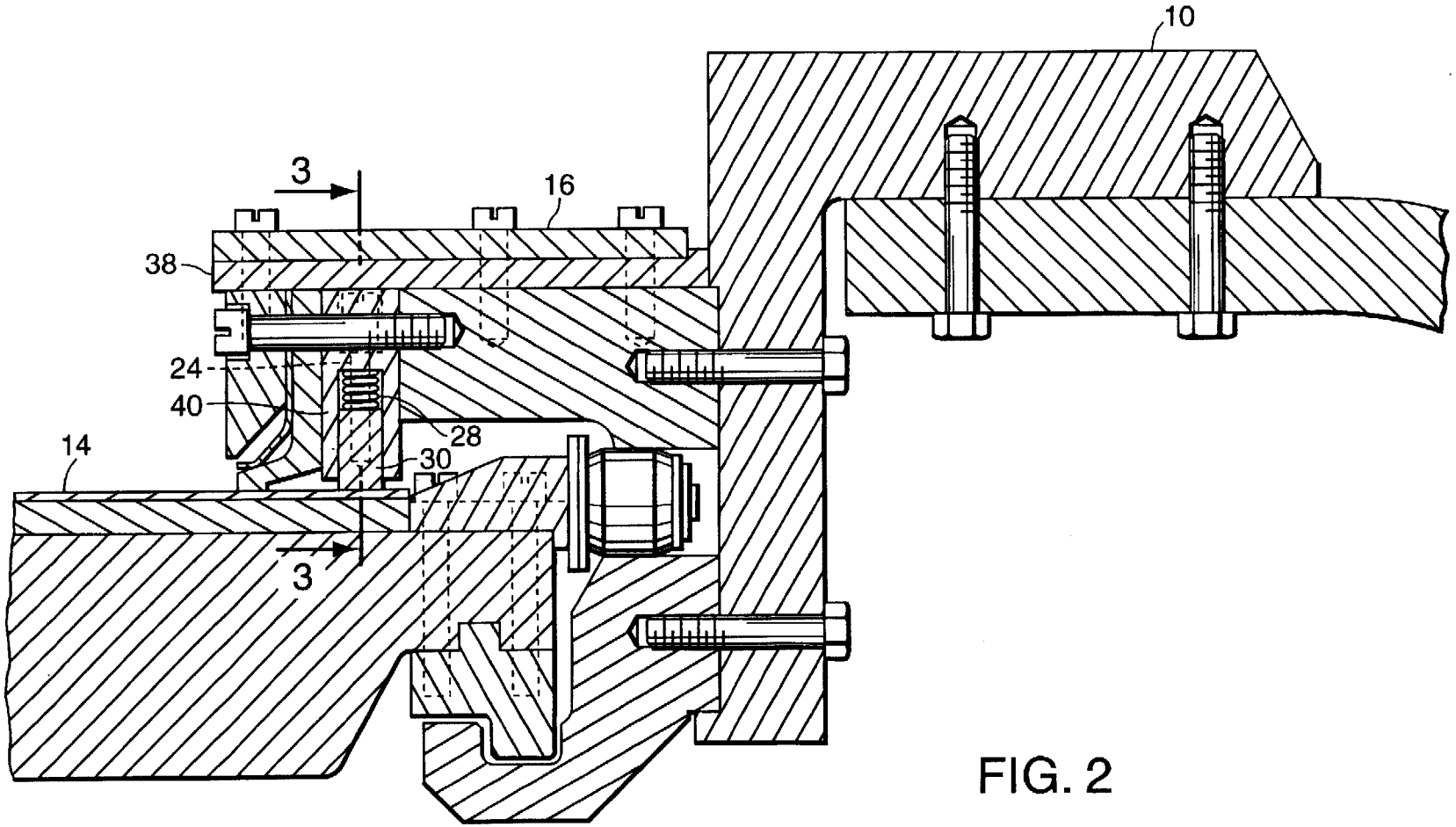
FIG. 2 is a section about 2—2 of FIG. 1 showing structural connections and metallic shielding at the gun port which is electrically bonded to the gun mount housing to provide EMI and EMP shielding.

Turning now to FIG. 2, a detail section of gun port shield structure 16 is shown. The section is a view about section 2—2 of FIG. 1. Brush pins 24 are shown mounted into metallic rails 40 in metallic rail slots 26. Brush pins 24 are threadably fixed to conductive brushes 30.

Figure 3:
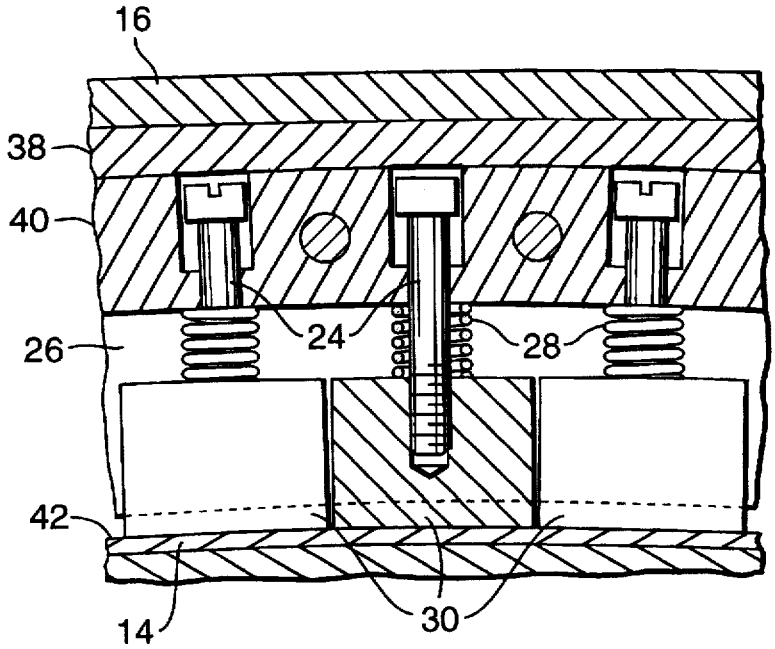
FIG. 3 is a section about 3—3 of FIG. 2 showing specially designed conductive brushes and brush pins which provide electrical bonding with the gun system metallic outer layer and the gun mount housing.

Considering now FIG. 3, a detail assembly of the present invention as applied to a gun port in a MK 45 type gun system is shown. In this preferred embodiment arrangement, the figure is a section view about 3—3 of FIG. 2. Brush pins 24 are shown mounted in metallic rails 40 and attached to conductive brushes 30. Upper rubber gasket 38 is layered over metallic rails 40. Metallic rail slots 26 are rectangular notches formed in metallic rails 40. A spring 28 is disposed between metallic rails 40 and conductive brushes 30 and each brush pin 24 is centrally located through springs 28 as shown. Slide surface 42 provides a frictional engagement surface between the structure of the present invention, gun port shield structure 16 and gun port 14.

In the preferred embodiment the present invention provides a self-sealing, dynamic EMI and EMP shield. Specifically, as gun port 14 slides to enable gun tube 12 to move in the vertical direction, slide surface 42, which forms a metal to metal slidable contact surface, impinges upon conductive brushes 30. This creates pressure against springs 28 which are resilient and thereby allow brush pins 24 to move upwards in metallic rail holes.

Springs 28 provide an electrical path between conductive brushes 30 and metallic rail 40. Electrical contact is established between brush pins 24 and the metallic rail hole. Electrical contact is also established between the conductive brushes 30 and the rail grooves 26. The shielding structure disclosed in the present invention is particularly effective to seal areas between moving sections where displacement of moving parts and the tolerances thereof create leaks and openings through which EMI and EMP may enter to detrimentally affect otherwise well sheltered control equipment. Whereas, the gun housing could provide sufficient shield from EMI and EMP, the shielding may be compromised at gun port 14 because of the need to move the gun through various angles in the vertical direction. The contact surface at slide surface 42 is therefore a potentially leaky area through which contamination may escape. To assure a positive seal, and provide a reliable shield for moving parts and for similarly disposed applications wherein deformation due to either dynamic or static pressure poses a risk of exposure to EMI and EMP against vital electrical and microprocessor controls, the present invention utilizes a self-sealing device as disclosed hereinabove. Specifically, the present invention enables positive electrical bonding to preclude leakage or passage of electromagnetic energy. More specifically, the present invention utilizes a series of brush pins 24 designed to electrically bond gun port 14 to gun mount housing 10 (See FIGS. 2 and 3). Brush pins 24 are mounted into metallic rails 40 in metallic rail slots 26 which are in turn connected to the gun mount housing 10. Electrical conductivity is provided at the sliding interface 42 between gun port 14 and conductive brushes 30. A conductive path is produced between the brushes 30 and rail 40. The brush pins 24 and springs 28 provide an alternate electrical path from conductive brushes 30 to rail 40. Rail 40 is connected to the gun mount housing 10.

Accordingly, the present invention provides a structure and device to protect EMI and EMP susceptible equipment from exposure due to leakage resulting, particularly, in a dynamic system wherein moving parts and joints need to be electrically bonded and sealed.

While a preferred embodiment of the present invention is shown as indicated in the drawings and the specification, it is understood that various changes and modifications may be made therein without departing from the spirit of the invention as defined by the scope of the appended claims.

What is claimed is:

1. An Electromagnetic Interference and Electromagnetic Pulse seal to provide an electrical bonding on a dynamic joint having a plurality of metallic layers with at least one layer being electrically conductive and dynamically slidable relative to another of said metallic layers, comprising:

means for making a dynamic contact with the electrically conductive layer;

means for guiding and supporting said means for making a dynamic contact to thereby maintain the electrical bonding between said electrically conductive slidable layer and one of said metallic layers;

means for providing resilience to said means for making a dynamic contact; and said means for dynamic contact and said means for providing resilience being disposed in said means for guiding and supporting.

2. The Electromagnetic Interference and Electromagnetic seal of claim 1 wherein said means for making a dynamic contact includes a brush pin mounted in a metallic layer of said plurality of metallic layers wherein one end of said pin makes contact with a non-conductive layer and isolates said dynamically slidable layer from an outer gun port shield, said shield comprising one of said plurality of metallic layers.

3. The Electromagnetic interference and Electromagnetic pulse seal of claim 1 wherein said means for guiding and supporting said means for making a dynamic contact includes metal rails formed in one of said plurality of metallic layers.

* * * * *